United States Patent [19]

Kao

[11] Patent Number: 4,807,586

[45] Date of Patent: Feb. 28, 1989

[54] JET WATER GUN

[75] Inventor: Aqee Kao, Keelung, Taiwan

[73] Assignee: Hung Mei Brush Co., Ltd., Keelung, Taiwan

[21] Appl. No.: 59,912

[22] Filed: Jun. 9, 1987

[51] Int. Cl.[4] ..... F41B 11/00; B05B 7/02

[52] U.S. Cl. ..... 124/73; 124/69; 222/145; 222/389

[58] Field of Search ..... 124/73, 71, 69, 63; 222/386.5, 389, 145, 129.2

[56] References Cited

U.S. PATENT DOCUMENTS

| | | | |
|---|---|---|---|
| 2,450,029 | 9/1948 | Wells | 124/73 X |
| 3,095,125 | 6/1963 | Bundy | 222/389 X |
| 3,445,067 | 5/1969 | Sheldall | 124/73 X |
| 4,215,802 | 8/1980 | Ornsteen | 222/389 X |
| 4,286,734 | 9/1981 | Tonge | 222/145 |
| 4,762,253 | 8/1988 | Palmert | 222/145 |

FOREIGN PATENT DOCUMENTS

| | | | |
|---|---|---|---|
| 2132494 | 7/1984 | United Kingdom | 124/71 |

*Primary Examiner*—Andrew V. Kundrat
*Assistant Examiner*—Peter M. Cuomo
*Attorney, Agent, or Firm*—Ladas & Parry

[57] ABSTRACT

A jet water gun comprises a hollow gun handle connected to a gun body having a cleanser chamber and a water passage. An expandable envelope in the chamber is connected to a valve through which water flows into the envelope to cause it to expand. Upon expansion, the envelope pressurizes the cleanser to make it flow out of the chamber. The cleanser flowing from the chamber is forced out of the gun together with a jet of water.

5 Claims, 2 Drawing Sheets

JET WATER GUN

BACKGROUND OF INVENTION

This invention relates to a jet water gun used for washing things, and particularly to an improved jet water gun having an expandable envelope in a cleanser chamber adapted for pressurizing the cleanser to flow out of the chamber when the envelope is expanded by being filled with water.

An object of the invention is to provide an improved jet water gun which can be manipulated easily to force out a cleanser together with a jet of water.

Another object of the invention is to provide an improved jet water gun which can force out effectively a cleanser together with a jet of water by means of water pressure.

The invention provides a jet water gun which comprises a gun handle, a first valve means at one end of the gun handle, a gun body having a chamber therein for receiving a cleanser, the chamber having a rear inlet communicated with a water passage of the handle, a front oulet, and a water passage smaller in cross-section than the water passage of the handle, a second valve means disposed at the rear inlet, a pressurizing envelope disposed in said chamber and connected to the second valve, the envelope being expandable to force the cleanser out of the chamber when water enters in the envelope upon opening of the second valve means, and a conduit extending from the front open end and having a nozzle at the front end thereof, and a third valve means disposed at the front outlet of the chamber for regulating the outward flow of the cleanser from the chamber and communicated with the conduit.

The exemplary preferred embodiment of the invention will be described in detail with reference to the accompanying drawings, in which:

DETAILED DESCRIPTION OF THE PREFERRED EMBODIMENT

Figure 1:
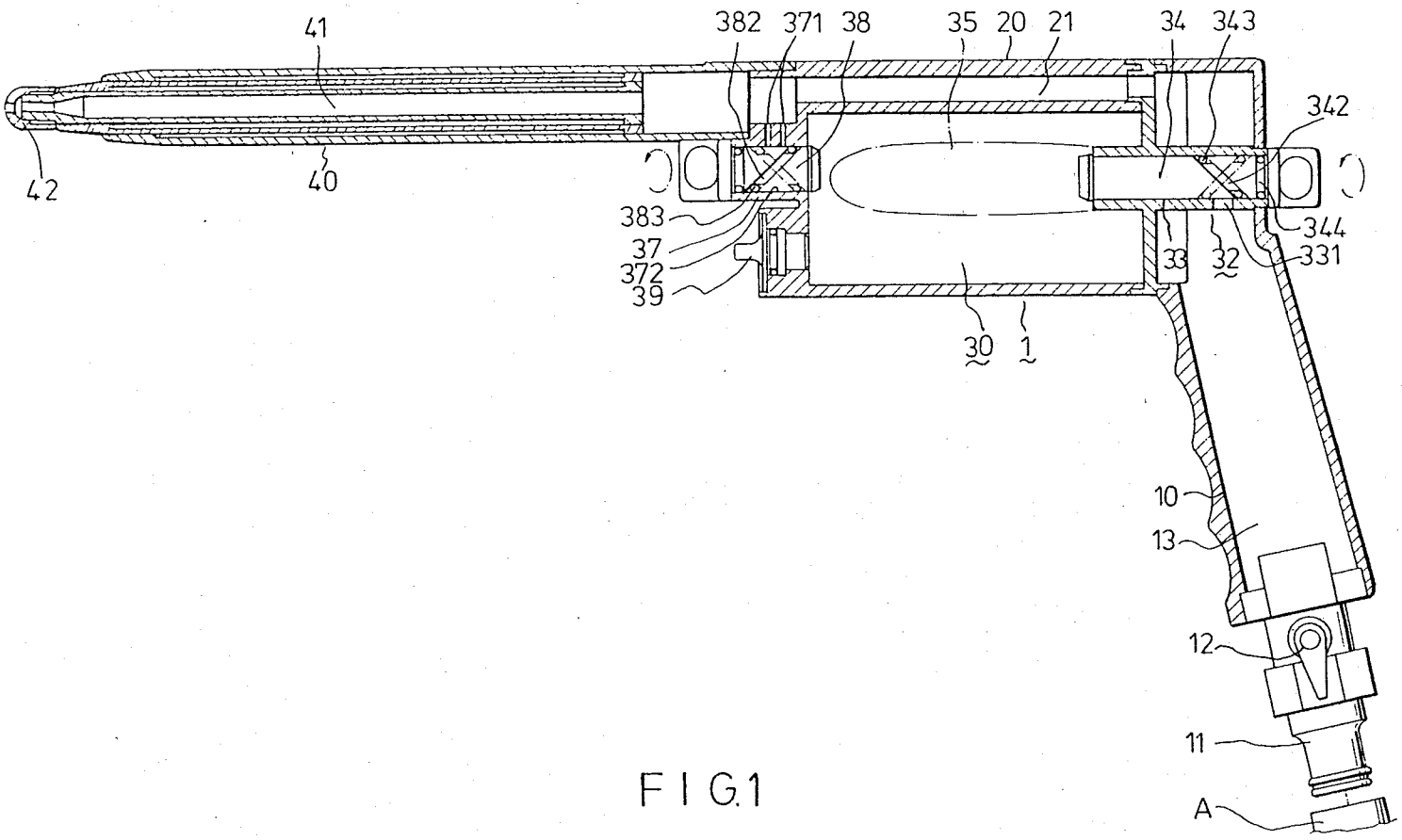
FIG. 1 is a sectional view of a jet water gun according to the present invention.
Figure 3:
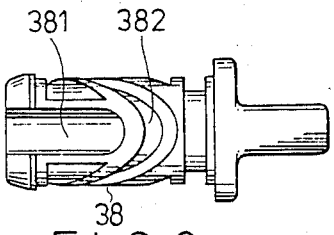
FIG. 3 is a top plan view of the cylindrical core of FIG. 2.
Figure 4:
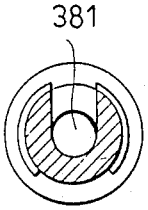
FIG. 4 is a sectional view taken along line 4—4 of FIG. 2.
Figure 2:
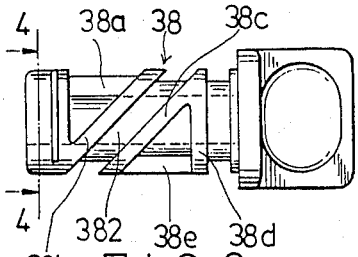
FIG. 2 is a side elevation view of a cylindrical core of a valve of the cleanser chamber.
Figure 5:
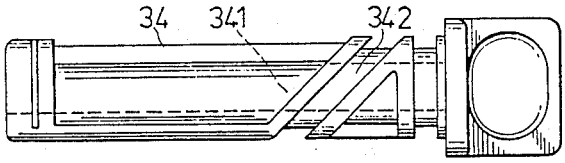
FIG. 5 is an elevation view of the core of another valve of the cleanser chamber.

Referring to the drawings, a jet water gun 1 is shown, having a gun handle 10, a gun body 20 with a cleanser chamber 30 and a water passage 21, and a conduit 40 with a nozzle 42. The gun handle 10 has an end connected with a water supply pipe A and is provided with a valve 11 which has an operating handle 12. A gradually tapered water passage 13 extends from the valve 11 to another end which is connected to the gun body 20.

The open rear end of the water passage 21 is communicated with the water passage 13, and the open front end thereof is communicated with the passage 41 of the conduit 40. The cleanser chamber 30 has a rear inlet at which is disposed a rear valve 32 for regulating a flow of water from the water passage 13 into an expandable envelope 35. At the front inlet of the cleanser chamber 30 is another valve 37 for regulating the outward flow of the cleanser from the chamber 30. A cap 39 is disposed at a port of the chamber 30 for introducing the cleanser into said chamber 30.

The valve 37 includes a cylindrical core 38 inserted rotatably in a cylindrical hollow of a valve casing 372. On the periphery of the cylindrical core 38 are provided ridges **38*a*, 38*b*, 38*c*, 38*d* and 38*e* which are in sliding contact with the inner side of the wall of the casing 372. A peripheral groove 382 extends around the periphery of the core 38 along a curved line formed by the intersection of the periphery of the core 38 with a plane inclining the axis of the cylindrical core 38. A sealing ring 383 is received in the peripheral groove 382. An axial bore 381 opens at the periphery of the core at one side of the plane of the groove 382. The valve casing 372 is provided with two outlet passages 371 which will communicate with the axial bore 381 when the valve 37 is opened. The operation of the valve 37 is similar to that of the valve 32** which will be described hereinunder.

The valve 32 is of the same construction as the valve 37, and includes a cylindrical casing 33 mounted between the wall of the chamber 30 and the wall of the handle 10, spanning the water pasage 13. In the wall of the cylindrical casing 33 is a radial opening 331. A cylindrical core 34 is mounted movably in the cylindrical casing 33. On the periphery of the cylindrical core 34 are an axial bore 341 to serve as a flow passage and a substantially oval-shaped peripheral groove 342 receiving a sealing ring 343 which contacts sealingly with the inner side of the cylindrical wall of the casing 33. An annular sealing ring 344 is received in an annular groove of the cylindrical core 34. The plane of the peripheral groove 342 is positioned at an incline with respect to the axis of the cylindrical core body 34. The axial bore 341 opens at the periphery of the cylindrical core 34 at the front side of the plane of the groove 342. The cylindrical core 34 can be adjusted manually to turn between a first position in which the axial bore 341 communicates with the radial opening 331 of the casing 33 and a second position, 180 degrees from the first position, in which the axial bore does not communicate with the radial opening 331. As shown in phantom lines in FIG. 1, when the peripheral groove 342 is in the first position, the axial bore 341 opens at the bottom side of the cylindrical core 34 to communicate with the opening 331. In this situation, the valve 32 is placed in an open position, and the water from the passage 13 flows into an envelope 35. Similarly, the valve 37 can be opened and closed by turning the core 38 between two positions within 180 degrees of each other.

The envelope 35 is made of a resilient flexible material and is connected to the valve 32. The envelope 35 is expandable and can be expanded when the water enters therein. The envelope 35 forces the cleanser out of the chamber 30 through the valve 37 when it is expanded. The cleanser flows into the axial bore 381 of the core 38 of the valve 37 and then flows out through the radial passages 371. When the cleanser from the chamber 30 flows out through the valve 37, the cleanser is mixed with the water from the passage 21, and the mixture is foreced outward through the conduit 40 and the nozzle 42.

In order to send out the cleanser together with the water, it is necessary to open only the valve 32 to allow water to flow into the envelope 35. When the envelope expands, some amount of the cleanser in the chamber 30 will be forced out of the chamber and mixed with the water.

With the invention thus explained, it is apparent that various modifications and variations can be made without departing from the scope of the invention. It is therefore intended that the invention be limited only as indicated in the appended claims.

What I claim is:

1. A jet water gun comprising:

a gun handle having a first end, an opposite second end, and a first water passage extending from said first end to said second end, a first valve means at said second end;

a gun body having a chamber therein for receiving a cleanser, said chamber having a rear inlet communicated with said first water passage, a front oulet, and a second water passage smaller in cross-section than said first water passage, adjacent to said chamber, and having a rear open end and a front open end;

a second valve means disposed at said rear inlet;

a pressurizing envelope disposed in said chamber and connected to said second valve, said envelope being expandable to force the cleanser out of said chamber when water enters in said envelope upon opening of said second valve means;

a conduit extending from said front open end and having a front end and a nozzle at said front end of said conduit; and a third valve means disposed at said front outlet for regulating the flow of the cleanser from said chamber and communicated with said conduit.

2. The jet water gun as claimed in claim 1, wherein said second valve means includes a casing having an inner cylindrical wall, a cylindrical core body inserted movably in said casing, said casing having a radial hole in the wall thereof, said core body having a peripheral groove extending around the periphery of said core body along a line formed by the intersection of the periphery of said core body and a plane inclining the axis of said core body, a sealing ring disposed in said peripheral groove, and an axial bore in said core body opening at the periphery of said core body at one side of said plane, said core body being movable between a first position in which said radial hole communicates with said axial bore, and a second position which is 180 degrees from said first position and in which said radial hole does not communicate with said axial bore.

3. A jet water gun comprising:

a gun handle having a first end, an opposite second end, and a first water passage extending from said first end to said second end;

a first valve means located at said second end;

a gun body extending from said second end of said gun handle and defining a cleanser chamber therein, said cleanser chamber having a rear inlet which communicates with said first water passage and a front outlet, said gun body also defining a second water passage having a smaller cross section than that of said first water passage and being located generally parallel to said cleanser chamber, said second water passage having a front open end and a rear open end, said rear open end communicating with said first water passage, said gun body also defining a third passage which communicates with said front open end of said second water passage and said front outlet of said cleanser chamber;

a second valve means disposed at said rear inlet of said cleanser chamber for regulating the flow of water through said rear inlet;

an expandable pressure envelope disposed in said cleanser chamber and connected to said second valve, said envelope expanding when water enters said envelope which occurs upon the opening of said second valve means, the expansion of said envelope acting to push cleanser out of said cleanser chamber into said second water passage;

a front conduit extending from said front open end of said second water passage and having a front end and a nozzle at said front end of said conduit; and a third valve means disposed at said front outlet of said cleanser chamber for regulating the flow of cleanser contained in said cleanser chamber to said second water passage.

4. The jet water gun as claimed in claim 3 wherein said second valve means is comprised of a generally cylindrical casing having an intercylindrical wall;

a cylindrical core body inserted movably in said casing, said cylindrical casing having a radial hole in a wall thereof, said core body having a peripheral groove extending around the periphery of said core body along a line formed by the intersection of the periphery of said core body and a plane inclining away from the axis of said core body; a sealing rind disposed in said peripheral groove, said core body defining an axial bore therein, said axial bore opening at the periphery of said core body at one side of said plane, said core body being movable between a first position in which said radial hole communicates with said axial bore, and a second position 180 degrees from said first position in which said radial hole does not communicate with said axial bore.

5. A jet water gun for dispensing a mixture of cleanser and water, said gun comprising:

a body having a first end and a second end and defining a water passage between said first and second ends, said body also defining a cleanser chamber therein;

an expandable envelope located in said cleanser chamber;

an envelope valve connecting said expandable envelope with said water passage such that upon opening of said envelope valve part of the water entering said first end and passing through said water passage to said second end enters said envelope and causes it to expand;

a water-cleanser valve located between said water passage and said cleanser chamber, whereby upon expansion of said envelope, the contents of said cleanser chamber is forced through said water-cleanser valve into said water passage to pass out of said second end.

* * * * *